US012152795B2

(12) United States Patent
Ingemi et al.

(10) Patent No.: US 12,152,795 B2
(45) Date of Patent: Nov. 26, 2024

(54) ELECTRICAL INTERFACE FOR HEAT PUMP

(71) Applicant: Dandelion Energy, Inc., New York, NY (US)

(72) Inventors: Paul Ingemi, New York, NY (US); Dung Duc Nguyen, New York, NY (US); John Dunn, New York, NY (US)

(73) Assignee: DANDELION ENERGY, INC., New York, NY (US)

( * ) Notice: Subject to any disclaimer, the term of this patent is extended or adjusted under 35 U.S.C. 154(b) by 205 days.

(21) Appl. No.: 17/852,085

(22) Filed: Jun. 28, 2022

(65) Prior Publication Data

US 2023/0417434 A1 Dec. 28, 2023

(51) Int. Cl.

| | |
|---|---|
| ***F24F 11/32*** | (2018.01) |
| ***F24F 5/00*** | (2006.01) |
| ***F24F 11/88*** | (2018.01) |

(52) U.S. Cl.

CPC ..... *F24F 11/32* (2018.01); *F24F 5/0046* (2013.01); *F24F 11/88* (2018.01)

(58) Field of Classification Search

CPC ..... F24F 5/0046; F24F 11/32; F24F 11/88
See application file for complete search history.

(56) References Cited

U.S. PATENT DOCUMENTS

| | | | | |
|---|---|---|---|---|
| 3,993,121 | A * | 11/1976 | Medlin | F25B 13/00 165/240 |
| 4,228,846 | A | 10/1980 | Smorol | |
| 6,062,482 | A * | 5/2000 | Gauthier | G05D 23/1919 236/78 D |

FOREIGN PATENT DOCUMENTS

| | | | |
|---|---|---|---|
| EP | 0098787 | A2 | 1/1984 |
| WO | WO2010093509 | A2 | 8/2010 |
| WO | WO2022016003 | A1 | 1/2022 |

OTHER PUBLICATIONS

European Patent Office, Extended European Search Report, issued in EU Application No. 23181784.2, dated Feb. 22, 2024, 11 pgs.
Peters Indu-Produkt Gmbh, "Individual Industrial Solutions", Relay Module No / NC CO Contact, retrieved May 17, 2022 from https://peters-indu.de/en/products/industrial/relay-module-no-nc-co-contacV, 14 pgs., Mercatorstrasse 41, 46485 Wesel, Germany.
CZH-LABS Electronics-Salon, "DPST 1 NO 1 NC 8Amp Power Relay Module, AC/DC 24V Control Voltage", retrieved May 17, 2022 from https://czh-labs.com/products/dpst-1 no-1 nc-8amp-power-relay-module-ac-dc-24v-control-voltage-1309, 2pgs.

* cited by examiner

*Primary Examiner* — Jonathan Bradford
(74) *Attorney, Agent, or Firm* — Fountainhead Law Group, PC

(57) ABSTRACT

An electrical interface selectively places a heat pump and a backup temperature control device in alternative electrical communication with a single power feed. A compressor of the heat pump may be in selective electrical communication with the power feed via a normally open relay. Removal of a control voltage results in opening of the normal open relay, and closing of a normally closed relay to place the backup temperature control device in selective electrical communication with the power feed. For a ground source heat pump, a ground loop pump may also be in selective electrical communication with the power feed (e.g., via a normally closed relay).

18 Claims, 5 Drawing Sheets

ELECTRICAL INTERFACE FOR HEAT PUMP

BACKGROUND

Unless otherwise indicated herein, the approaches described in this section are not prior art to the claims in this application and are not admitted to be prior art by inclusion in this section.

Heat pumps are useful for many purposes. A prominent application for a heat pump is as a component for a Heating, Ventilation, and Air Conditioning (HVAC) system used to control ambient temperature within an environment. One example of such an environment is a residential or industrial building space.

Heat pumps are complex mechanisms. They can include refrigerant circulation networks comprising conduits, heat exchangers (e.g., coils), valves, and pumps, as well as other air circulation networks comprising other conduits, heat exchangers, valves, and pumps.

On occasion, a heat pump may experience a failure. Such failed operation of a heat pump can imperil the well being of individuals and/or devices that are relying upon HVAC systems in order to maintain a safe ambient temperature within a space.

SUMMARY

An electrical interface selectively places a heat pump and a backup temperature control device in alternative electrical communication with a single power feed, thereby simplifying installation and reducing cost. In particular embodiments, a compressor of the heat pump may be in selective electrical communication with the power feed via a normally open relay. Removal of a control voltage results in opening of the normally open relay, and closing of a normally closed relay to place the backup temperature control device in selective electrical communication with the power feed. For a ground source heat pump, a ground loop pump may also be in selective electrical communication with the power feed (e.g., via a normally closed relay).

DETAILED DESCRIPTION

Described herein are methods and apparatuses implementing an electrical interface with a heat pump. In the following description, for purposes of explanation, numerous examples and specific details are set forth in order to provide a thorough understanding of embodiments according to the present invention. It will be evident, however, to one skilled in the art that embodiments as defined by the claims may include some or all of the features in these examples alone or in combination with other features described below, and may further include modifications and equivalents of the features and concepts described herein.

Figure 1A:
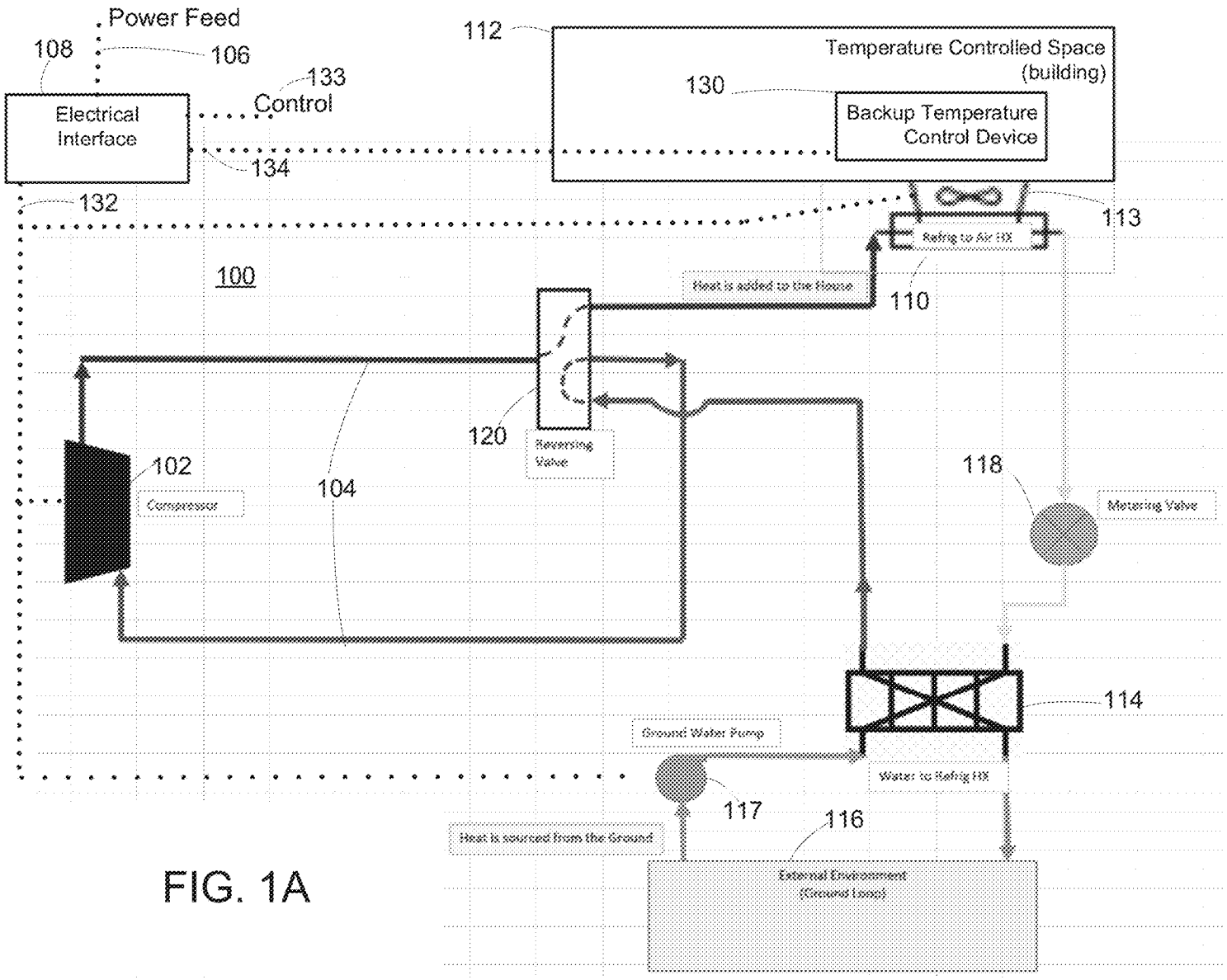
FIG. 1A shows a simplified diagram of an example heat pump system according to an embodiment operating in a heating mode.

FIG. 1A shows a simplified diagram of a heat pump system 100 according to an embodiment, in a heating mode of operation. The heat pump system comprises the following elements.

A compressor (COMP) 102 functions to move a working fluid through a circuit 104. The compressor is electrically connected to a power feed 106 via an electrical interface 108 in order to operate.

A working fluid may comprise a refrigerant. A working fluid may experience a phase change as it circulates through the circuit.

A primary side heat exchanger 110 functions to exchange heat with the controlled temperature space 112. The controlled temperature space may be the inside of a building, for example. A fan 113 may operate to assist in the circulation of air within the space.

A secondary side heat exchanger 114 operates to source/sink heat into a thermal reservoir 116 located outside of the temperature controlled space.

The specific (ground) heat pump system of FIG. 1A relies upon the temperature of the ground to serve as a thermal reservoir. A ground loop filled with water is circulated by ground water pump 117. However, embodiments are not limited to this particular configuration.

Some heat pump systems may rely upon the temperature of outside air to serve as a thermal reservoir. Particular heat pump systems could even rely upon a source of geothermal energy, in order to serve as a thermal reservoir.

During the heating mode of operation shown in FIG. 1A, the ground loop is extracting heat from the ground and the heat pump is rejecting this heat into the house. During the process of heating the home, hot gaseous refrigerant from the compressor enters the refrigerant-to-air heat exchanger, and as heat is imparted to the interior space the gas changes phase to a liquid refrigerant. It continues this process until the refrigerant is in a liquid state and is subcooled a few degrees further to condensation of refrigerant vapor.

A metering valve 118 regulates the flow of refrigerant through the circuit. A reversing valve 120 changes a direction of flow of the refrigerant, allowing the circuit to selectively extract or add heat to the temperature controlled space.

Figure 1B:
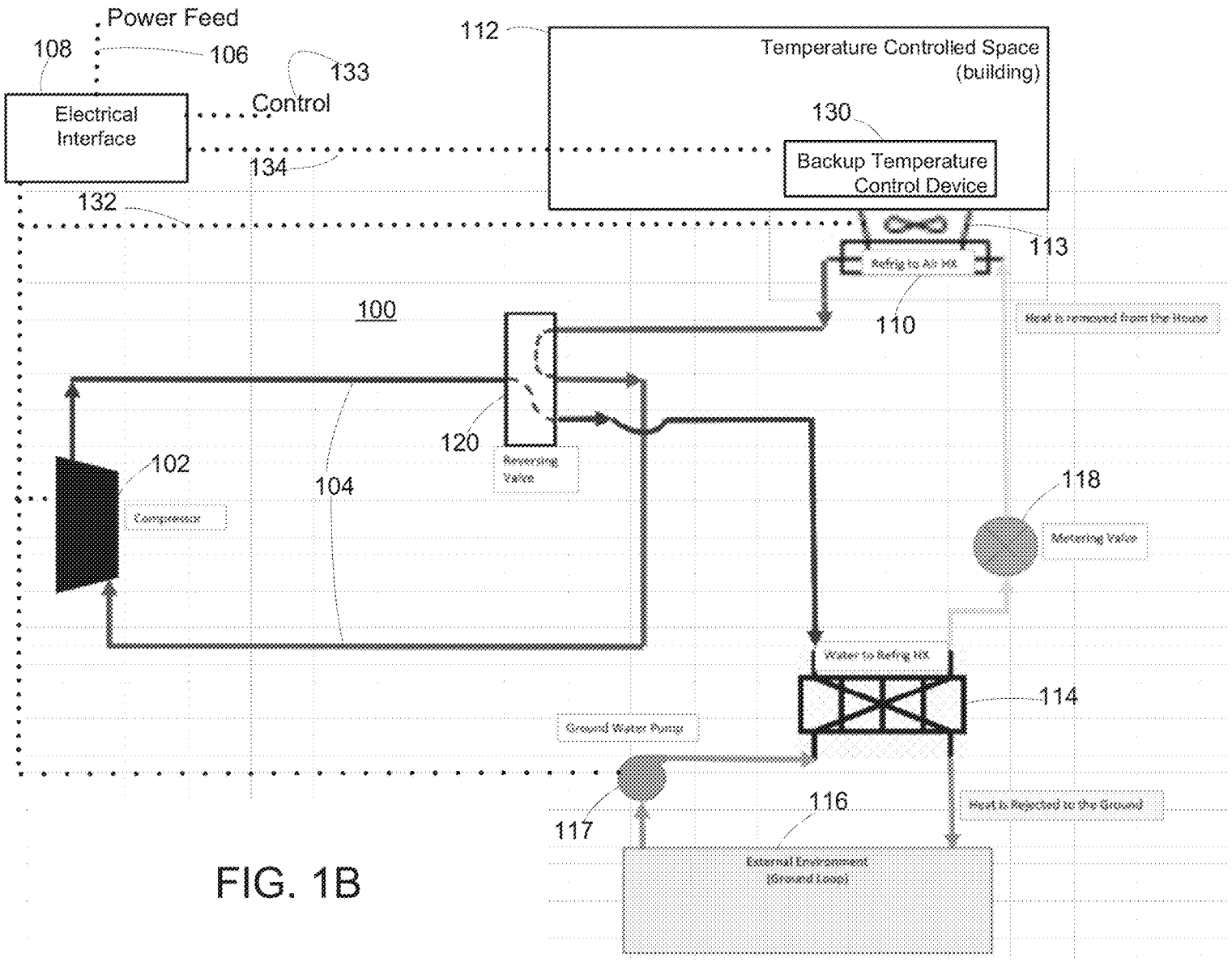
FIG. 1B shows a simplified diagram of an example heat pump system according to an embodiment operating in a cooling mode.

FIG. 1B shows a simplified view of the heat pump system of FIG. 1A operating in a cooling mode. In FIG. 1B, heat is being extracted in order to cool the space.

To mitigate risks associated with loss of temperature control in the event of a system failure, as shown in FIGS. 1A-1B, a separate backup temperature control device 130 (e.g., heater, cooler, or heater/cooler) may be supplied together with the heat pump unit. Such a backup temperature control device serves to provide temperature control until the heat pump unit can be repaired.

To operate this backup temperature control device, electrical power is required. Thus, embodiments provide the electrical interface which avoids the need for a second power feed for the backup device. This reduces cost and complexity of the heat pump installation.

In particular, the compressor and the water pump are in communication with a first output 132 of the electrical interface. Under normal operating conditions, power from the power feed is routed to the first output.

The electrical interface also includes a control input 133 and a second output 134. Upon removal of the control input, the electrical interface communicates power from the power feed to the backup temperature control device, rather than to the compressor.

Figure 2:
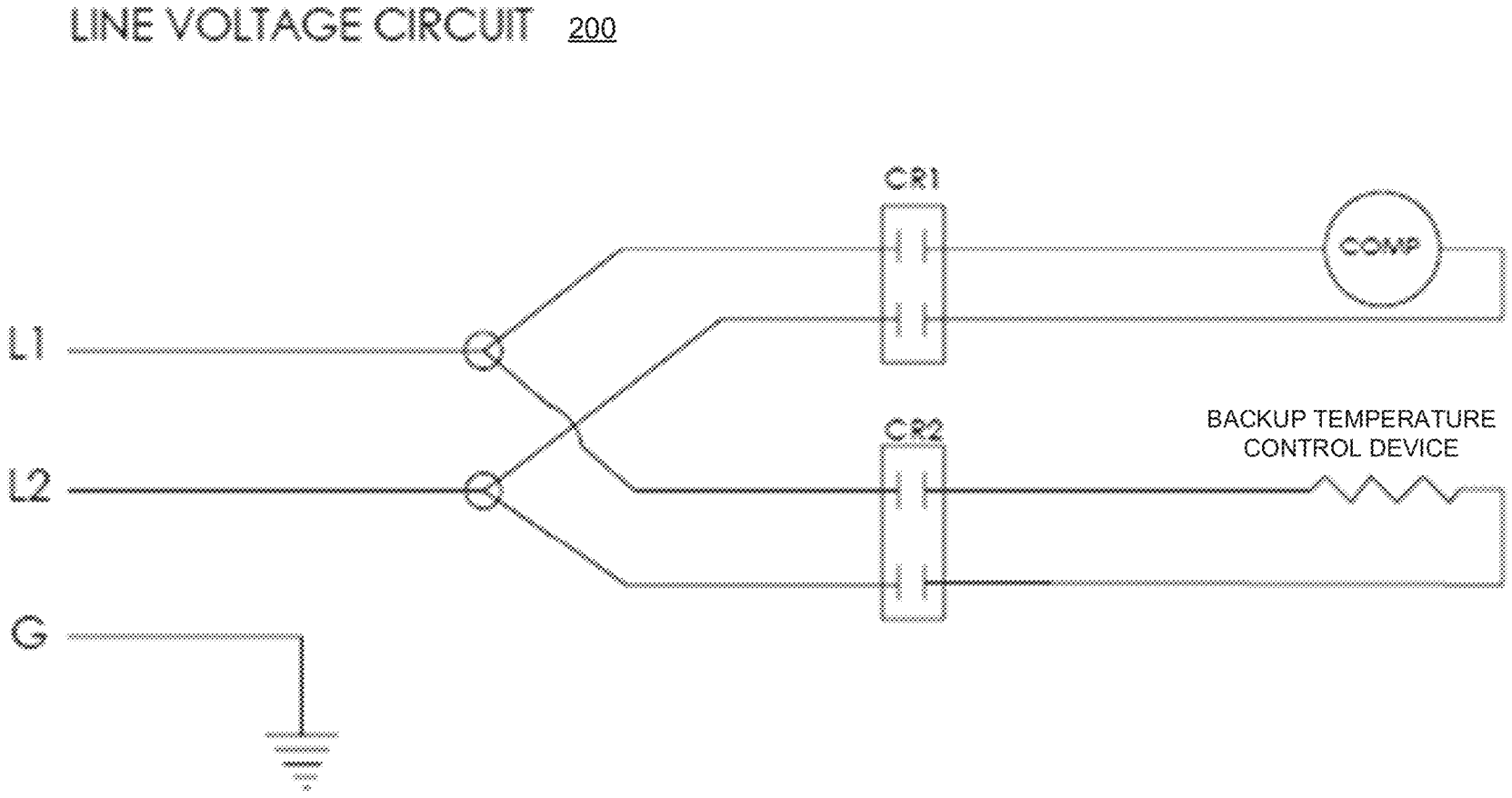
FIG. 2 shows a simplified view of a line voltage circuit according to an embodiment.
Figure 3:
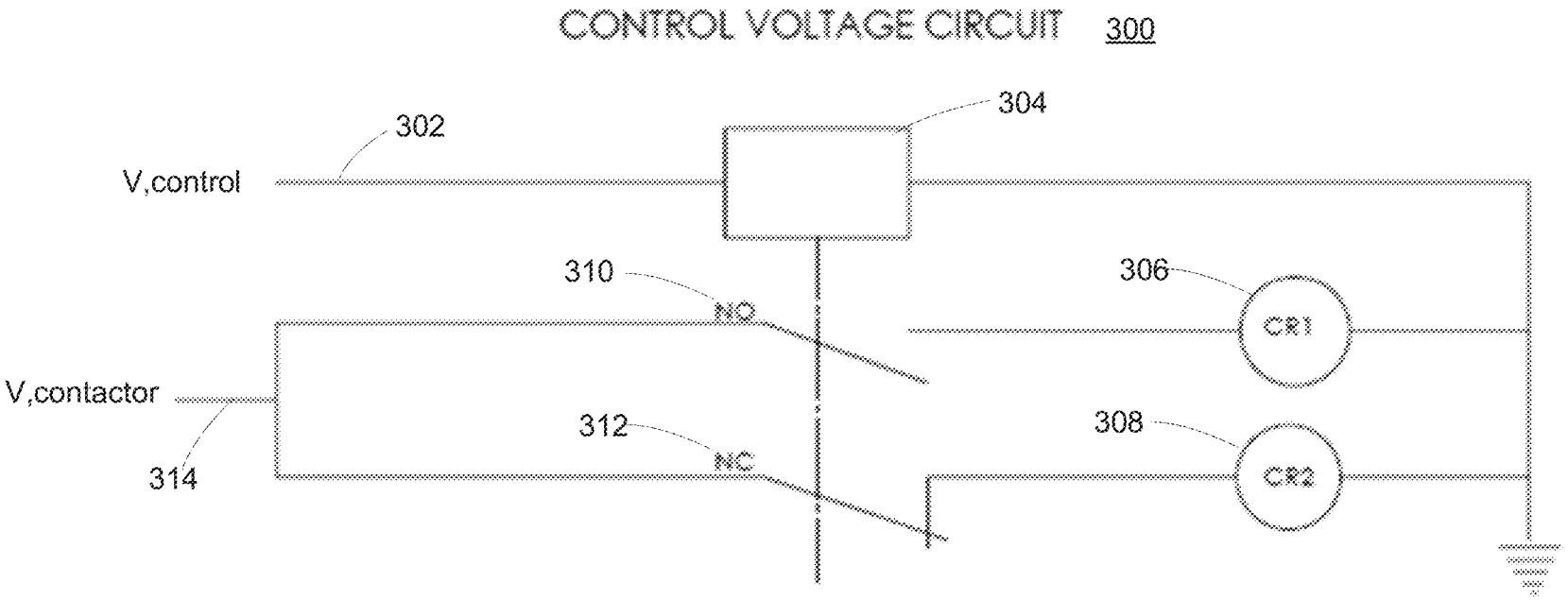
FIG. 3 shows a view of a control voltage circuit according to an embodiment.

FIG. 2 shows a simplified view of a line voltage circuit 200 according to an embodiment. FIG. 3 shows a view of a control voltage circuit 300 according to an embodiment.

In particular, specific embodiments provide a way of connecting power to multiple elements of the system, by using a set of relays. These relays reliably provide electrical power to the compressor, while offering a robust and mechanical structure of isolating the compressor and providing power to the backup temperature control device in the event of failure.

In the embodiment of FIG. 3, a control voltage 302 is connected to a relay coil 304 which then mechanically actuates a set of contacts, one being Normally Open (NO) and one being Normally Closed (NC). In such an arrangement, Vcontrol power is alternatively provided to the control coils on contactors CR1 306 and CR2 308.

One example of a candidate relay suitable for use is the Relay Module NO/NC CO Contact available from Peters Indu-Produkt of Germany. This is an example of a singular unit containing NO and NC contacts.

Embodiments could also be implemented in two (2) relays, one NO and one NC powered by the voltage signal. An example is the DPST 1 NO 1 NC 8 Amp Power Relay Module available from CZH-LABS of Shenzhen, China.

The contactors are switched using application of a control voltage to close Normally Open relay 310 and thereby provide power to the compressor (COMP). Normally Closed relay 312 is opened by application of a control voltage 302 and thereby isolates the backup heater from the power feed.

Utilizing an embodiment of an electrical interface as shown in FIG. 3, power can be applied to one load (e.g., the compressor) or to the other load (e.g., the backup heater/cooler), but not to both electrical loads at the same time. Such a configuration simplifies installation and reduces cost, while still ensuring reliable temperature control over the space.

Figure 4:
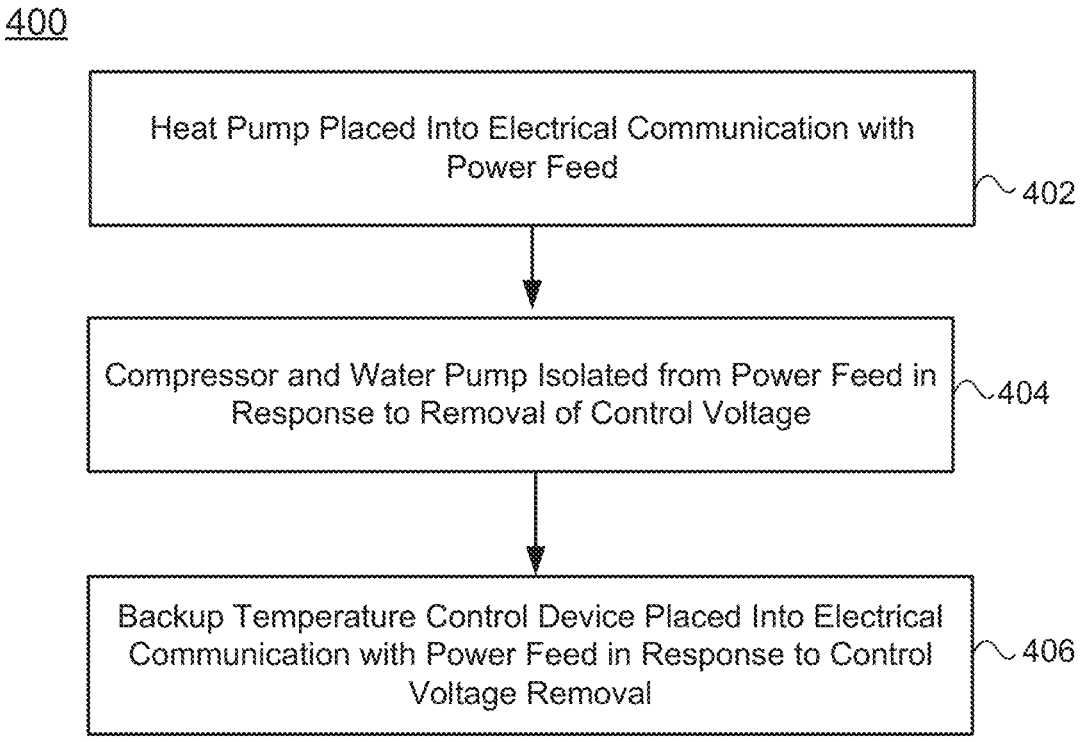
FIG. 4 shows a simplified flow diagram of a method according to an embodiment.

FIG. 4 shows a simplified flow diagram of a method according to an embodiment. At 402, a heat pump is installed in electrical communication with a power feed.

At 404, the heat pump compressor and pump are selectively electrically isolated from the power feed in response to removal of a control voltage. At 406 a backup temperature control device is selectively placed in electrical communication with the power feed in response to the control voltage removal.

The above description illustrates various embodiments of the present invention along with examples of how aspects of the present invention may be implemented. Other embodiments are possible.

For example, while the above description discloses the backup temperature control device as being a heater, this is not required. Alternative embodiments could feature a backup temperature control device that is a cooler, or a combination heater/cooler.

Moreover, while the above description discloses that removal of a control voltage results in opening of a normally open relay, and closing of a normally closed relay, this is not required. According to alternative embodiments, receipt of a control voltage may result in opening of a normally closed relay, and closing of a normally open relay.

The above examples and embodiments should not be deemed to be the only embodiments, and are presented to illustrate the flexibility and advantages of the present invention as defined by the following claims. Based on the above disclosure and the following claims, other arrangements, embodiments, implementations and equivalents will be evident to those skilled in the art and may be employed without departing from the spirit and scope of the invention as defined by the claims.

What is claimed is:

1. An apparatus comprising:

an electrical interface configured to receive a power feed and produce first output to route the power feed to a heat pump in thermal communication with a space and a second output to route the power feed to a backup temperature control device in thermal communication with the space, the electrical interface comprising:

a control input;

a normally open relay between the power feed and a compressor of the heat pump that is, wherein the heat pump is configured to perform selective heating and cooling of the space; and a normally closed relay between the power feed and the backup temperature control device, wherein the backup temperature control device is configured to perform a same one of heating or cooling the space as being performed by the heat pump at a time when the heat pump fails;

wherein, during a first mode of operation, the control input is configured to receive a first voltage signal to open the normally closed relay and to close the normally open relay to isolate the backup temperature control device from electrical communication with the power feed and connect the compressor to the power feed, and wherein, in the event of a heat pump system failure, the control input is configured to receive a second voltage signal to close the normally closed relay and to open the normally open relay, to isolate the compressor from electrical communication with the power feed and connect the backup temperature control device to the power feed.

2. The apparatus as in claim 1, wherein the space comprises a building interior.

3. The apparatus as in claim 1, wherein the heat pump comprises a ground source heat pump.

4. The apparatus as in claim 3, wherein the heat pump comprises a geothermal heat pump.

5. The apparatus as in claim 3, wherein the normally closed relay is further in electrical communication with a ground loop pump.

6. The apparatus as in claim 1, wherein the second voltage signal corresponds to removal of a voltage resulting in opening of the normally open relay, and closing of the normally closed relay in the event of a heat pump system failure.

7. The apparatus as in claim 1, wherein the compressor is in electrical communication with the normally open relay through a first contactor.

8. The apparatus as in claim 7, wherein the backup temperature control device is in electrical communication with the normally closed relay through a second contactor.

9. A method comprising:

receiving a power feed in an electrical interface, the electrical interface comprising a control input, a first output to route the power feed to a heat pump, and a second output to route the power feed to a backup temperature control device, wherein the heat pump is configured to perform selective heating and cooling of a space, and wherein the backup temperature control device is configured to perform a same one of heating or cooling the space as being performed by the heat pump when the heat pump at a time fails;

placing a compressor of the heat pump in electrical communication with the power feed through a normally open relay coupled to the first output of the electrical interface; and placing a backup temperature control device in electrical communication with the power feed through a normally closed relay coupled to a second output of the electrical interface, wherein, during a first mode of operation, the control input is configured to receive a first voltage signal to open the normally closed relay and to close the normally open relay to isolate the backup temperature control device from electrical communication with the power feed and connect the compressor to the power feed, and wherein, in the event of a heat pump system failure, the control input is configured to receive a second voltage signal to close the normally closed relay and to open the normally open relay to isolate the compressor from electrical communication with the power feed and connect the backup temperature control device to the power feed.

10. The method as in claim 9, wherein the heat pump is in thermal communication with a building space.

11. The method as in claim 10, wherein:

the heat pump is in thermal communication with the space via a fan; and the fan is powered for both cases where the compressor or backup temperature device is used.

12. The method as in claim 10, wherein the backup temperature device is in thermal communication with a building space.

13. The method as in claim 9, wherein the heat pump comprises a ground source heat pump.

14. The method as in claim 13, wherein a ground loop pump is in electrical communication with the power feed through the normally open relay.

15. The method as in claim 9, wherein the second voltage signal corresponds to removal of a voltage from the control input resulting in opening of the normally open relay, and closing of the normally closed relay in the event of a heat pump system failure.

16. An apparatus comprising:

a heat pump comprising a plurality of components, the heat pump configured to perform selective heating and cooling of a space;

a backup temperature control device, the backup temperature control device configured to perform a same one of heating or cooling the space as being performed by the heat pump at a time when the heat pump fails;

a normally open relay coupled between a power feed and one or more components of the heat pump;

a normally closed relay coupled between the power feed and the backup temperature control device, wherein the normally open relay and the normally closed relay are coupled to at least one control input, wherein, during a first mode of operation, the at least one control input is configured to receive at least one first voltage signal to open the normally closed relay and to close the normally open relay to isolate the backup temperature control device from electrical communication with the power feed and connect the compressor to the power feed, and wherein, in the event of a heat pump system failure, the at least one control input is configured to receive at least one second voltage signal to close the normally closed relay and to open the normally open relay, to isolate the compressor from electrical communication with the power feed and connect the backup temperature control device to the power feed.

17. The method as in claim 16, wherein:

the heat pump comprises a ground source heat pump; and a ground loop pump of the heat pump is in selective electrical communication with the power feed through the normally open relay.

18. The apparatus as in claim 16, wherein the at least one control input is a single control input, and wherein the at least one first voltage corresponds to receiving a voltage on the single control input and the at least one second voltage signal corresponds to removal of the voltage from the single control input.

* * * * *